US007482942B2

(12) United States Patent
Kajander et al.

(10) Patent No.: US 7,482,942 B2
(45) Date of Patent: Jan. 27, 2009

(54) ARRANGEMENT AND METHOD FOR STARTING A MACHINE

(75) Inventors: Vesa Kajander, Klaukkala (FI); Arto Lehtonen, Vantaa (FI)

(73) Assignee: ABB Oy, Helsinki (FI)

( * ) Notice: Subject to any disclaimer, the term of this patent is extended or adjusted under 35 U.S.C. 154(b) by 200 days.

(21) Appl. No.: 11/443,261

(22) Filed: May 31, 2006

(65) Prior Publication Data

US 2007/0008161 A1 Jan. 11, 2007

(30) Foreign Application Priority Data

May 31, 2005 (FI) ..... 20050581

(51) Int. Cl.
*G08B 21/00* (2006.01)

(52) U.S. Cl. ..... 340/679; 340/522; 340/516; 381/56

(58) Field of Classification Search ..... 340/679, 340/521, 522, 540, 502, 516; 307/84; 318/101, 318/103; 381/56
See application file for complete search history.

(56) References Cited

U.S. PATENT DOCUMENTS 4,266,221 A * 5/1981 Hawkins ..... 340/679
4,270,800 A * 6/1981 Barry ..... 299/1.05
4,649,288 A 3/1987 Barry et al.
5,189,388 A * 2/1993 Mosley et al. ..... 340/309.7
5,264,834 A * 11/1993 Silken et al. ..... 340/679
5,347,165 A 9/1994 Miyazono
5,574,437 A * 11/1996 Schwinn et al. ..... 340/679
5,652,566 A * 7/1997 Lambert ..... 340/507

FOREIGN PATENT DOCUMENTS

DE 3624099 A1 1/1988
GB 1 387 828 3/1975
GB 2 100 039 A 12/1982

* cited by examiner

*Primary Examiner*—Toan N Pham
(74) *Attorney, Agent, or Firm*—Buchanan Ingersoll & Rooney PC

(57) ABSTRACT

An arrangement is disclosed for an industrial drive in which at least one machine or part of machine can be started from a location separate from the machine or part of machine. The arrangement includes an alarm device that can be activated before the part of machine is started. The arrangement includes two sources and two devices for controlling a sound source that can be activated before starting the machine so that the alarm sounds from both sound sources are intermittent and jointly include a substantially solid continuous sound.

13 Claims, 3 Drawing Sheets

ARRANGEMENT AND METHOD FOR STARTING A MACHINE

RELATED APPLICATION

The priority application claims priority under 35 USC § 119 to Finnish Patent Application No. FI20050581, filed May 31, 2005, the contents of which are hereby incorporated by reference in their entirety.

BACKGROUND

A system and method are disclosed for use when starting an electric motor used in an industrial drive such as a paper mill, or several electric motors simultaneously.

Automation has increased the number of applications in which machines are started from control rooms or away from the site without visual contact with the machine. Drives in which such situations occur are used in the paper industry and various hoist drives. Safety and protection systems have been implemented to protect personnel, machinery and equipment from injury and damage. The safety aspect is important both financially and in terms of the working environment and working comfort, and mandatory regulations have been issued in several areas.

For example, paper making and finishing machines require a function known as a start-up alarm before any part of the machine is allowed to be started. A simple horn or horns controlled by digital outputs from the control system of paper machine drives have been used for this purpose. With safety requirements further increasing, even stricter criteria for alarm devices have been developed and are under development. For example, the safety standard for paper making and finishing machines EN1034-1 (CEN, European Committee for standardization: EN 1034-1:2000, "Safety of machinery—Safety requirements for the design and construction of paper making and finishing machines", approved 17 Sep. 1999), currently requires a level of safety corresponding to Category 2 as defined in the standard EN954-1 (CEN: "Safety of machinery—Safety-related part of control systems, approved 11 Jul. 1996). According to Category 2, a fault in an alarm device must be detected.

Prior art solutions for detecting a fault in an alarm device include, for example, the one described in the publication U.S. Pat. No. 5,652,566. An acoustic sensor is fitted beside the alarm device, and the sensor must detect the alarm sound and provide the control unit with a feedback signal. In the absence of a feedback signal, another alarm device is activated. The use of an acoustic sensor in an industrial environment requires an analysis of detected noise in order to reliably determine whether the sound originates from an alarm device or another source. Environmental sources of noise in an industrial facility can vary considerably depending on the location, which makes analysis even more difficult. On the other hand, people with normal hearing can distinguish between relatively quiet sounds despite background noise.

SUMMARY

A new, economical and functionally reliable way of detecting faults in an alarm system is disclosed.

The solution according to the invention provides a reliable and secure indication of a fault in an alarm device. Operating personnel will always receive definite information of a fault situation as they must also monitor actual alarms and react to them in a way called for by the operating conditions and prescribed in the instructions. Correspondingly, instructions must be provided for alarm device fault indication with a different audible signal and the measures called for by such a situation.

Under normal operating conditions, the start-up alarm comprises a continuous and solid alarm sound that has been used in a conventional solution and thus does not impose any changes to customary operations.

If the sound sources are controlled by digital outputs from the machine controls, no additional equipment needs to be developed to secure the start-up alarm. The first horn of each alarm device is daisy-chained with the first horns of the other alarm devices, which facilitates in locating the position of a fault.

According to a preferred embodiment, the sound sources within a pair of alarm horns are fitted in connection with each other, which means that installation and maintenance will not require any additional work.

According to a preferred embodiment, a test button is arranged in connection with the start-up alarm and can be used to operate the alarm device. Normally, the sound sources for the start-up alarm are activated automatically during machine start-up.

BRIEF DESCRIPTION OF THE DRAWINGS

In the following the invention will be described in detail with the help of certain embodiments by referring to the enclosed drawings, where.

DETAILED DESCRIPTION

Figure 1:
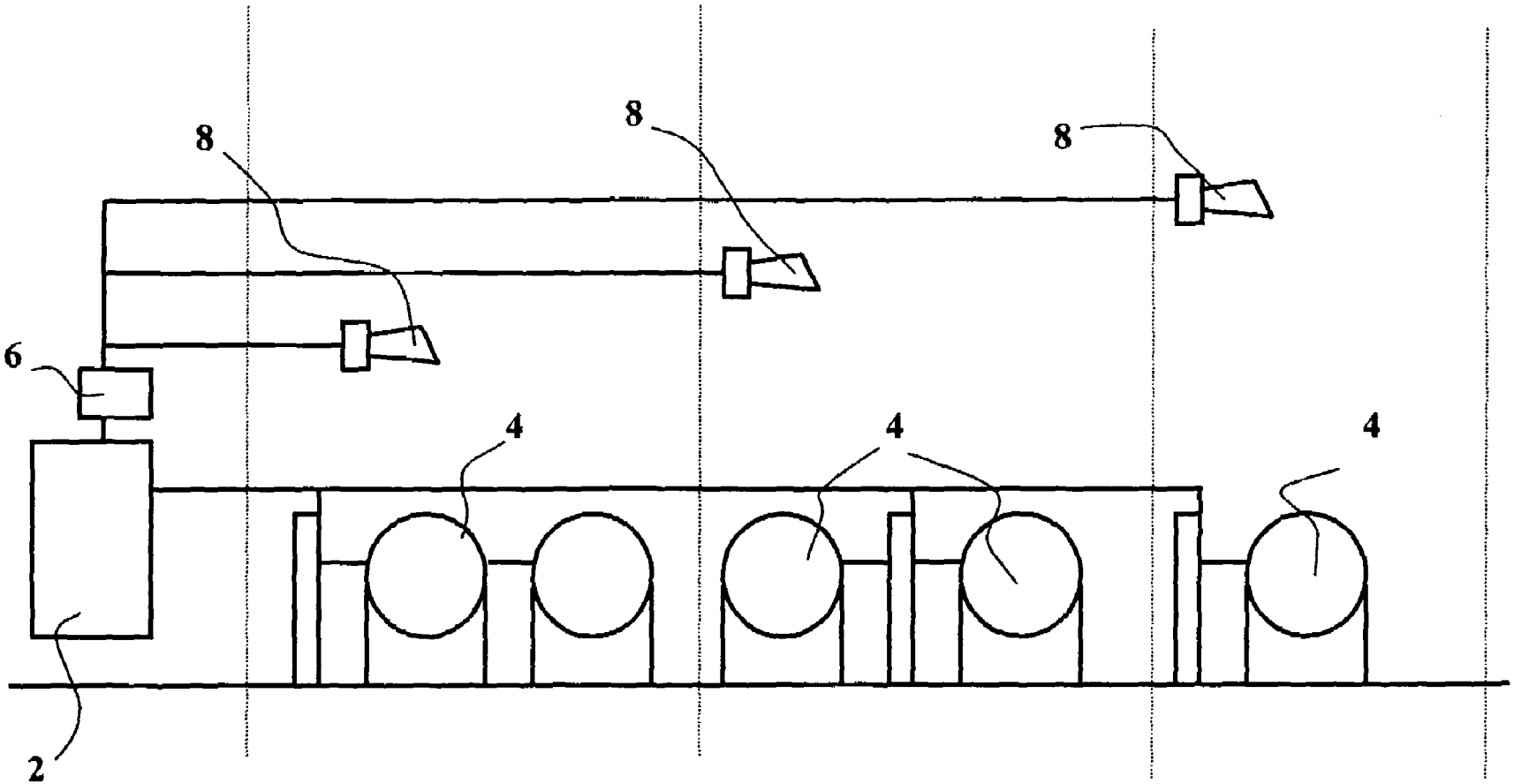
FIG. 1 is a schematic illustration of an industrial drive in connection with which the invention is applied.

FIG. 1 is a schematic illustration of an industrial drive in connection with which the invention is applied. A drive control device 2 is used to provide a start-up instruction to the motors 4. Before start-up, a signal is transmitted from the control device 2 through the start-up alarm circuit 6 to the alarm devices 8, causing an alarm sound signal to be generated at the site of the motors. The placement and operating method of the horns depends on the application and its requirements. For example, the standard EN-1034 referred to above defines the duration of the start-up alarm, a waiting period for staff to move to a safe area, and a start-up readiness period during which start-up may occur. There may be several alarm horns in the same room, controlled by the same device. On the other hand, there may only be one motor and one alarm device if the start-up control is located away from the operating site.

Figure 2:
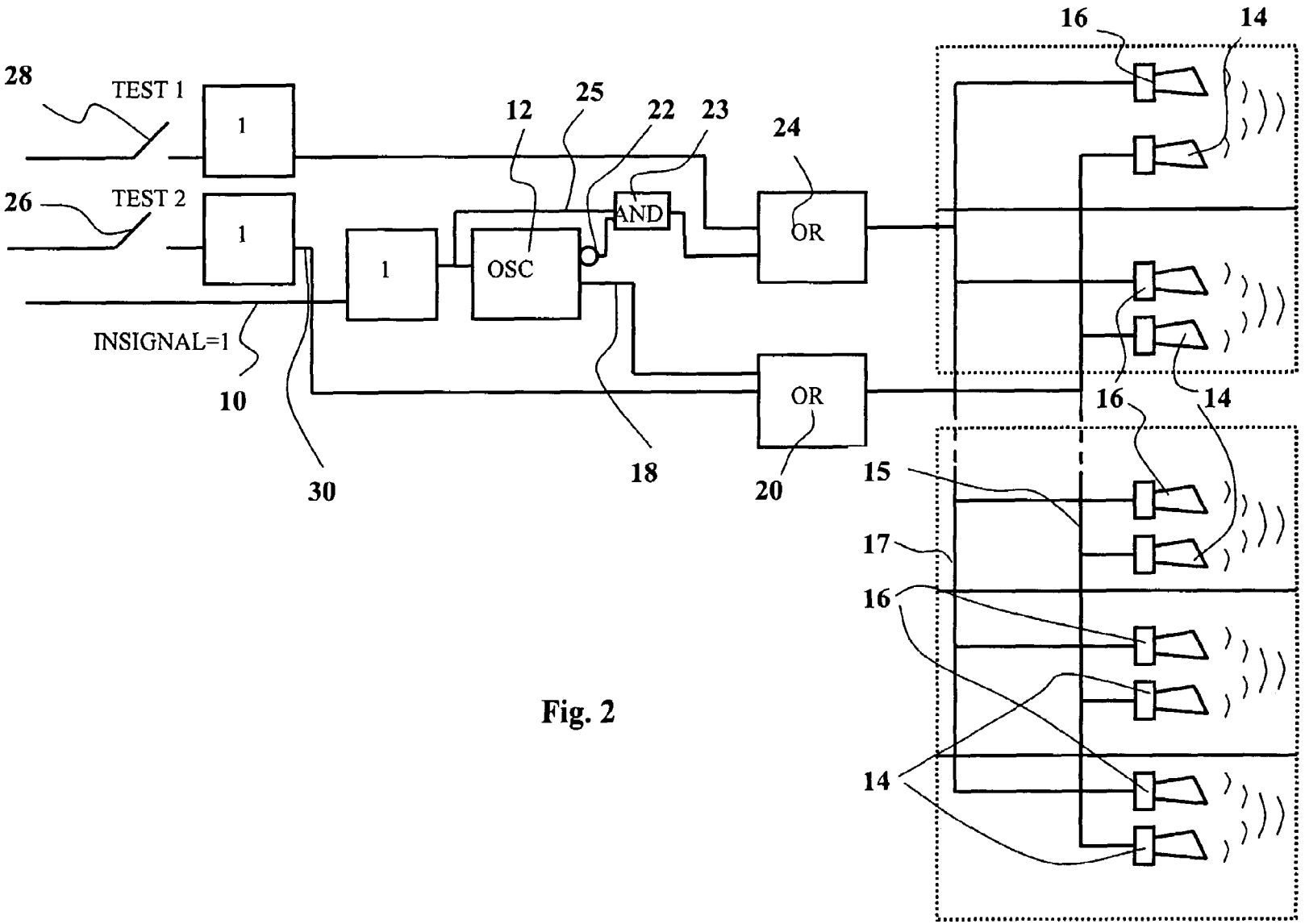
FIG. 2 illustrates an arrangement according to the invention.
Figure 3:
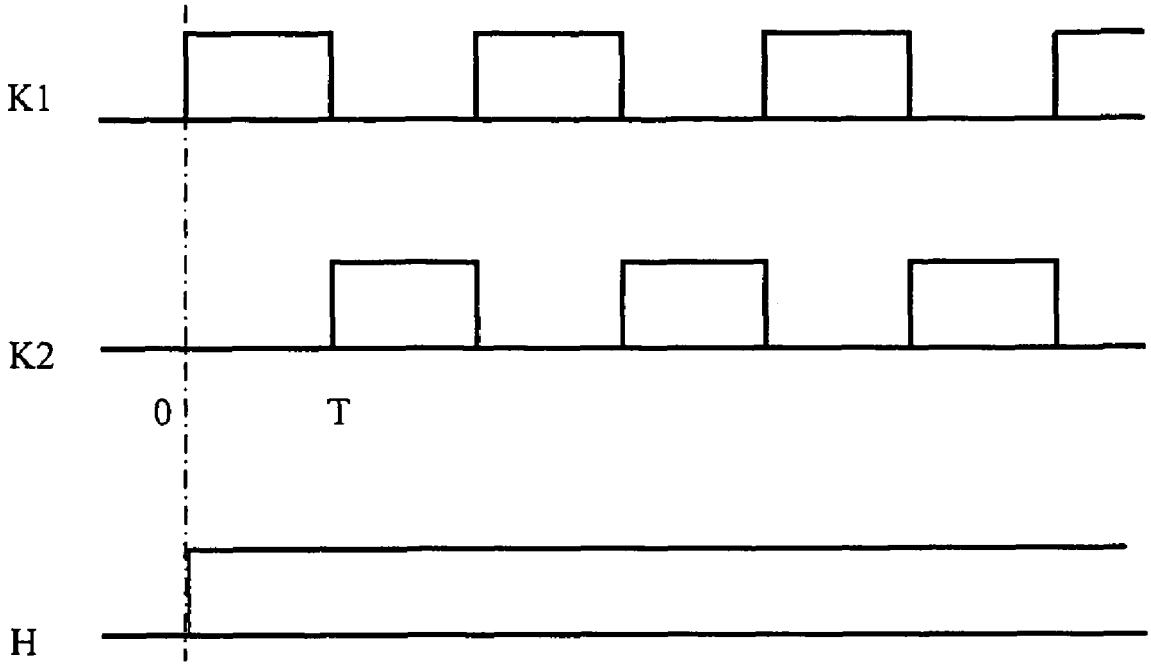
FIG. 3 illustrates signals according to the invention.

In a solution according to the invention, each alarm horn is doubled, meaning that each location in which the start-up alarm must be audible includes two horns with mutually independent controls. The alarm device comprises several sound sources, half of which are connected to a first chain and the other half connected to a second chain, the first chain being controlled with a first means of control and the second chain being controlled with a second means of control, and each sound source within the first chain forming a pair of alarm horns with one sound source within the second chain. FIG. 2 illustrates an embodiment of the invention. In a normal start-up situation, the control output of the machine being started provides a start-up alarm signal 10 belonging to the start-up sequence. When active, this signal controls the oscillator 12. The oscillator 12 generates a sequence of pulses in opposite phases with a pulse frequency of approximately 0.5 to 1 second. Two chains controlling alarm horns are connected after the oscillator, the first one controlling the horns 14 and the second one controlling the horns 16. The output 18 of the oscillator 12 is conducted to an OR circuit 20 whose output is used to control the horns 14 chained to the first chain through the first bus 15. The second output 22 of the oscillator 12 is inverted in relation to the pulse from output 18. The output 22 is conducted through an AND circuit 23 to an OR circuit 24, the output of which is correspondingly used to control the horns 16 chained to the second chain through the second bus 17. The second input 25 of the AND circuit 23 is taken from the start-up alarm signal, meaning that the output of the AND circuit 23 will only have a signal when the start-up alarm signal is active. FIG. 3 illustrates the sequences of pulses K1 and K2 from output 18 and output 22 of the oscillator 12. The pulse duration T is equal to the phase difference between the outputs. Therefore, alarm signals having a duration of T are alternately generated from horns 14 and 16, and these combined result in an uninterrupted alarm sound H that can be heard by personnel on site and responded to accordingly.

Two sound sources forming a pair of alarm horns are preferably installed substantially close to each other. The pair of horns can also be installed within the same enclosure.

If one of the alarm chains or a horn connected to a chain fails, the horns emit an intermittent sound signal indicating a fault in the alarm system. In such a case, the operation of the alarm device is tested using test buttons 26 and, correspondingly, 28 arranged for both alarm chains. When button 26 is pressed, a signal is activated at output 30 and conducted to the second input of the OR circuit 20, causing the horns 14 to generate a continuous alarm sound. Correspondingly, when button 28 is pressed, a signal is activated at the second input of the OR circuit 24, resulting in a continuous alarm sound to be heard from the second horns 16. Pressing the test button does not initiate the normal start-up sequence. It only generates a test alarm that applies to each of the alarm chains separately.

According to the invention, a solid alarm signal is generated at the start of the machine start-up sequence. A fault situation is indicated by an intermittent sound, and the operation of the alarm devices is tested using a designated test button for each of the parallel circuits.

In the above, the invention has been described by reference to certain embodiments. However, the description should not be considered as limiting the scope of patent protection; the embodiments of the invention may vary within the scope of the claims.

The invention claimed is:

1. An arrangement for an industrial drive, in which at least one machine can be started from a location separate from the machine, said arrangement comprising:

an alarm device that can be activated before the part of machine is started, wherein the alarm device comprises:

two sound sources and two means for controlling a sound source that can be activated before starting the machine so that the alarm sounds from both sound sources are intermittent and jointly comprise a substantially solid continuous sound.

2. An arrangement according to claim 1, wherein the sound sources are controlled on the basis of digital outputs of the machine's controls using substantially similar control signals (K1, K2) with a mutual phase difference equal to a duration (T) of the control signals.

3. An arrangement according to claim 1, wherein the alarm device comprises several sound sources, half of which are connected to a first chain and the other half connected to a second chain, the first chain being controlled with a first means of control and the second chain being controlled with a second means of control, and each sound source within the first chain forming a pair of alarm horns with one sound source within the second chain.

4. An arrangement according to claim 1, wherein two sound sources form a pair of alarm horns installed substantially close to each other.

5. An arrangement according to claim 4, wherein the sound sources within the pair of alarm horns are fitted within the same enclosure.

6. An arrangement according to claim 1, wherein a fault in one of the sound sources within an alarm device and/or its means of control only affects the alarm sound from the particular sound source, resulting in that the alarm sound produced by the alarm device is intermittent in the case of a fault.

7. An arrangement according to claim 1, wherein the arrangement includes a test button for activating the alarm device.

8. An arrangement according to claim 7, wherein each of the sound sources within a pair of alarm horns has a designated test button for generating a test alarm.

9. An arrangement according to claim 8, wherein during the start-up of the machine, all of the sound sources are activated automatically.

10. An arrangement according to claim 1, wherein said industrial drive is a paper machine.

11. A method for generating a start-up alarm in an industrial facility in which a machine can be started from a separate location, wherein the method includes:

generating a first and second control signals that are alternately active, conducting the first control signal through a first bus to a first sound source, and conducting the second control signal through a second bus to a second sound source, such that the first and second sound sources generate an alarm sound that is substantially uninterrupted.

12. A method according to claim 11, wherein several sound sources daisy-chained with each other are connected to the first and the second bus correspondingly.

13. A method according to claim 11, wherein said machine is a paper machine.

* * * * *